United States Patent [19]

Lazar

[11] Patent Number: 4,982,954

[45] Date of Patent: Jan. 8, 1991

[54] EXERCISE DEVICE OF SKILL AND AMUSEMENT

[76] Inventor: Janos Lazar, 1752 Milton St., Redwood City, Calif. 94063

[21] Appl. No.: 331,412

[22] Filed: Mar. 31, 1989

[51] Int. Cl.[5] ..... A63B 21/22

[52] U.S. Cl. ..... 272/93; 272/128; 446/242

[58] Field of Search ..... 272/128, 93, 25 R; 446/170, 265, 266, 242, 411, 450

[56] References Cited

U.S. PATENT DOCUMENTS

| | | | |
|---|---|---|---|
| 3,935,669 | 2/1976 | Potrzuski et al. | 446/242 |
| 4,398,892 | 8/1983 | Solomon | 446/265 |
| 4,445,297 | 5/1984 | D'Andiode et al. | 446/438 |
| 4,674,987 | 6/1987 | Sober | 446/170 |

FOREIGN PATENT DOCUMENTS

| | | | |
|---|---|---|---|
| 300588 | 9/1917 | Fed. Rep. of Germany | 446/266 |

*Primary Examiner*—Stephen R. Crow

*Attorney, Agent, or Firm*—Flehr, Hohbach, Test, Albritton & Herbert

[57] ABSTRACT

This invention relates to an exercise device of skill and amusement. The device includes a generator within a hollow body which defines a predetermined path. Manual manipulation of the hollow body forces the generator to move along the predetermined path which in turn results in the production of electric power which is used to sequentially energize a number of light or audio means. Activation of sequential light or audio means provides amusement and an indication of the amount of manual skill being exercised by the user.

14 Claims, 6 Drawing Sheets

EXERCISE DEVICE OF SKILL AND AMUSEMENT

BRIEF DESCRIPTION OF THE INVENTION

This invention relates generally to an exercise device of skill and amusement. More particularly, it relates to a device which is manually manipulated to produce an audio or visual response, the level of the response being indicative of the extent of the user's coordinated motion.

BACKGROUND OF THE INVENTION

Many previously available devices are utilized to alleviate what is considered by some as the drudgery of exercise. A variety of other devices test an individual's skill and coordination. Still other devices are intended to simply entertain and amuse. Rarely does a single device encompass all of these attributes. A number of devices of entertainment and amusement known in the prior art include a light or lights powered by a battery. However, applicant is not aware of a single device of this type which utilizes a generator to power its light means. Such a combination has not been taught heretofore, primarily because of the difficulty involved in generating sufficient motion to drive the generator in order to power the light means.

OBJECTS AND SUMMARY OF THE INVENTION

It is a general object of the present invention to provide a device to diminish the dissatisfaction associated with exercise.

It is another object of the present invention to provide a device to test and develop an individual's skill and coordination.

It is a related object of the present invention to provide a device for enjoyment and amusement.

It is still another object of the present invention to provide a device powered by an efficient generator arrangement.

These and other objects are achieved by an exercise device which will be described in more detail hereinafter. This device includes generator means having stator means and rotor means supported for rotation relative to one another along a predetermined path of movement in order to generate electric power. This electric power is used to energize either light or audio producing means. The device is manually manipulated by the user to cause the generator to move along its predetermined path in a controlled way.

In a preferred embodiment of the present invention, the device defines a circular path and uses a plurality of lights powered by the generator. A centrifugal switch forming part of the generator selectively directs electric power to the various lights in a predetermined way, depending on how the user causes the generator to move around its path.

BRIEF DESCRIPTION OF THE DRAWINGS

Other objects and advantages of the invention will become apparent upon reading the following detailed description and upon reference to the drawings, in which.

DETAILED DESCRIPTION OF THE INVENTION

Figure 1:
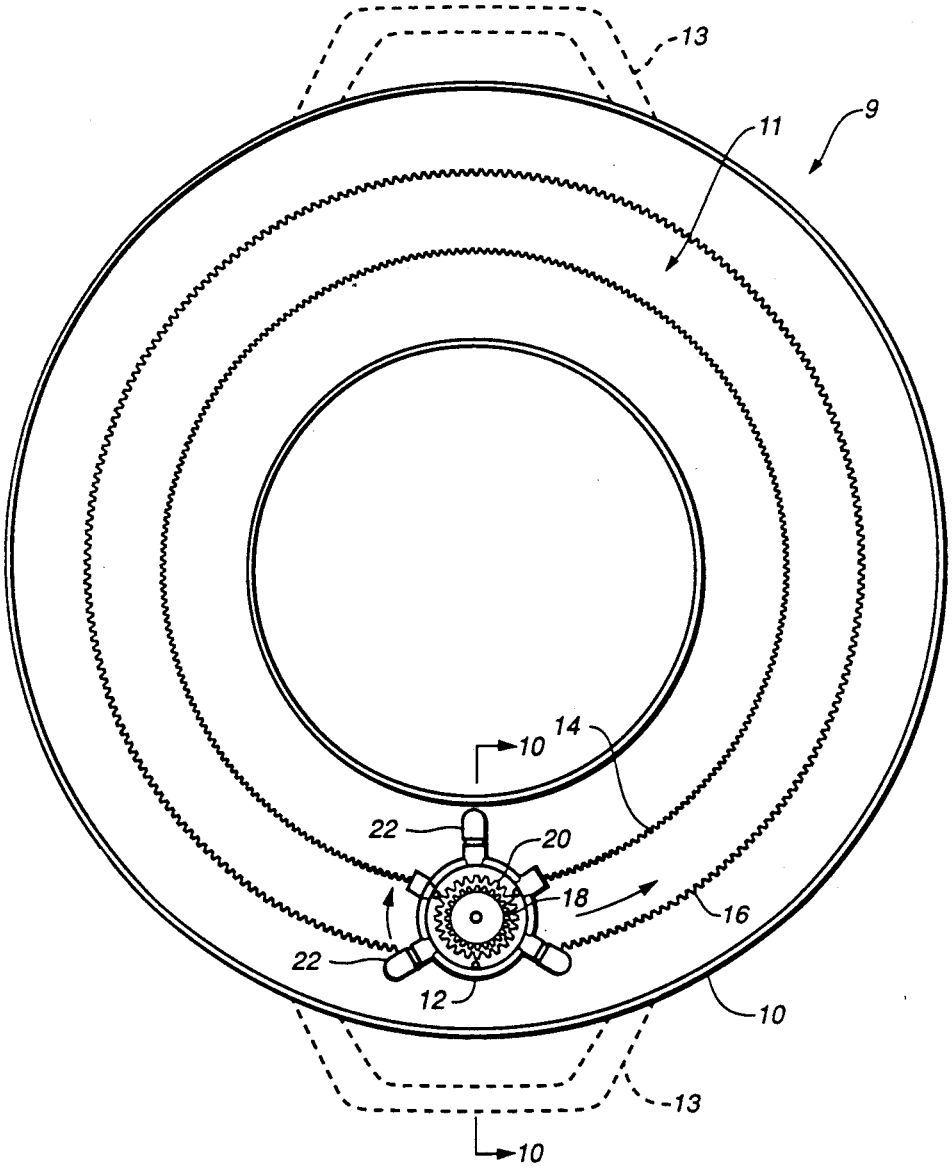
FIG. 1 is a plan view of an exercise device designed in accordance with one embodiment of the present invention.

Turning now to the drawings, wherein like components are designated by like reference numerals throughout the various figures, attention is directed to FIG. 1. This figure illustrates an exercise device 9 which is designed in accordance with the present invention. This device includes an annular, hollow body 10, preferably constructed of clear or translucent plastic. The interior of hollow body 10 defines a predetermined annular path 11. A generator assembly 12 is contained within the interior of the hollow body 10 for movement, either clockwise or counterclockwise, around path 11. As will be seen hereinafter, the user of device 9 manually manipulates body 10 in a way which causes generator assembly 12 to move either clockwise or counterclockwise along path 11. As will also be seen, this causes a generator forming part of assembly 12 to energize a series of lights also forming part of the assembly in a way which depends on the speed in which the assembly is caused to move about path 11.

Still referring to FIG. 1, device 10 includes an inner gear train 14 and an outer gear train 16 which extend continuously around and define the radially innermost and radially outermost extent of path 11. As will be seen below, these radially inner and outer gear trains 14 and 16 are responsible for supporting the generator assembly as the latter moves along path 11 in a way which causes the generator to produce electricity.

The hollow body 10 is preferably formed of a durable, translucent plastic. The shape of the hollow body 10 in an actual working embodiment is realized by utilizing injection molding techniques which are well known in the art.

The hollow body 10 may include optional handles 13 to facilitate manipulation of the device. The shape of the hollow body is further appreciated by reference to FIG. 10 which provides a side view of the hollow body 10 with the generator assembly 12 embodied therein. Optional handle 13 is also depicted in the Figure.

Predetermined annular path 11 is seen as an area elevated from the remainder of the hollow body 10. Specifically, the inner gear train 14 is embedded into an extended area of the hollow body 10. Similarly, still referring to FIG. 10, it is observed that the outer gear train 16 is embedded into an extended area of the hollow body 10.

The inner gear train 14 and outer gear train 16 are embedded in the hollow body 10 using the same well-known injection molding techniques. The gear trains are of standard proportions. Specifically, they are proportioned to engage the gear teeth of the generator assembly 12, to be more fully described at this time.

Figure 2:
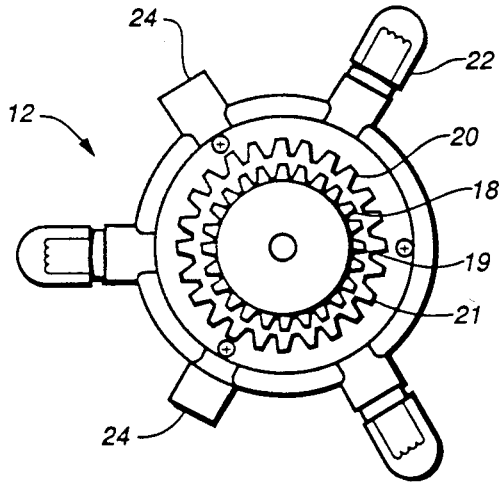
FIG. 2 is a plan view of a specifically designed generator forming part of the device of FIG. 1.
Figure 3:
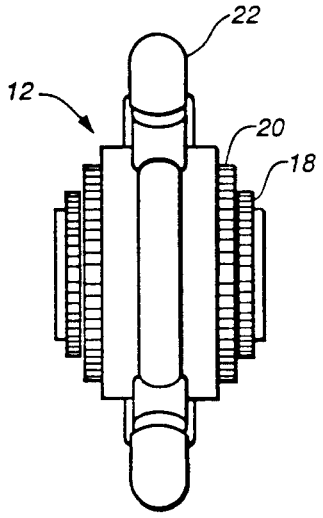
FIG. 3 is a side view of the generator of FIG. 2.
Figure 4:
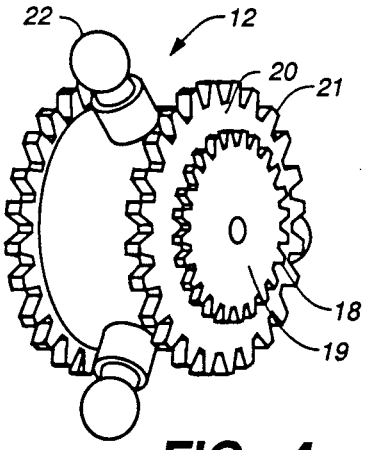
FIG. 4 is a perspective view of the generator means of FIG. 2 with gear teeth extended beyond the outer circumference of the generator's body in order to reveal the nature of the gear teeth.

FIG. 2, FIG. 3 and FIG. 4 provide alternate views of the generator assembly 12. FIG. 2 provides a plan view of the generator assembly 12 and detailed views of the inner gear teeth 18, outer gear teeth 20. The inner gear teeth 18 are at the exterior circumference of the first gear disc 19. The outer gear teeth 20 are at the exterior circumference of the second gear disc 21. The gear teeth are of a standard proportion allowing them to engage the inner gear train 14 and outer gear train 16, as previously described.

The generator assembly 12 of FIG. 2 also includes a plurality of light means 22. The light means 22 are standard light bulbs which are preferably of various decorative colors. FIG. 2 also depicts a plan view of two centrifugal switch means 24, to be more fully described herein.

The nature of the generator assembly 12 is more fully appreciated by reference to FIG. 3 which provides a side view of the generator assembly 12, along with its constituent parts of inner gear teeth 18, outer gear teeth 20 and light means 22.

FIG. 4 provides a perspective view of the generator assembly 12. To appreciate the nature of the gear teeth, the teeth are extended beyond the outer circumference of the generator's body. The first gear disc 19, and the inner gear teeth 18 are depicted. Similarly, the second gear disc 21 and the outer gear teeth 20 are depicted. In addition, the light means 22 can be more fully appreciated in FIG. 4.

The generator assembly 12 is preferably uniformly formed from a durable metallic substance. However, a durable plastic structure formed from injection molding techniques may also be successfully employed. Having described the exterior of the generator assembly 12, particular attention turns to the details of its interior.

Figure 5:
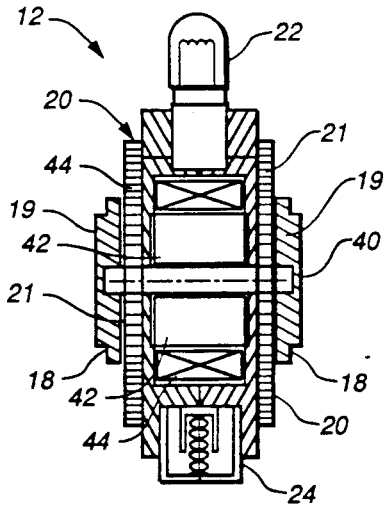
FIG. 5 is a cross-sectional side view of the generator means of FIG. 2.

FIG. 5 is a cross-sectional view of the generator assembly 12. Shaft 40 is the central supporting member of the generator assembly 12. A permanent magnet rotor 42 and two identical external pinion gears 19 (first gear discs) are attached to the shaft 40 to form a rotor subassembly.

The stator 44 (coil assembly) is housed in two identical sections to which external gears 21 (second gear discs) are connected. The second gear discs 21 will drive the coil assembly 44 and the remainder of the generator body 12 in the opposite direction of the permanent magnet rotor 42 which is driven by the first gear discs 19. Electric power generated by the coil assembly 44 turning in a direction opposite to the permanent magnet rotor 42 is channeled to a conductor, or output means, which feeds the electricity to the light means 22.

Figure 14:
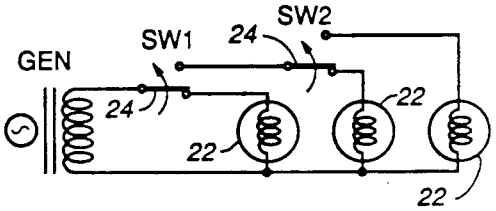
FIG. 14 is a schematic of the circuitry embodied within the generator of either embodiment.

The generator assembly 12 also includes two centrifugal switch means 24. Each switch means includes a mass-spring system made up of a normally closed switch which is opened only by a predetermined amount of centrifugal force. FIG. 14 represents a schematic of the centrifugal switch circuit, specifically showing the two switch means 24 as SW1 and SW2. At low centrifugal force the generator produces electricity which is fed to the first light means 22 because the low centrifugal force is insufficient to move the centrifugal switches which are normally closed. As the centrifugal force increases, the first centrifugal switch of lower mass, SW1, swings open to disconnect the connection to the first light and to engage a connection to the second centrifugal switch, SW2, which is still closed. This connection leads to a second light means 22 which is preferably a light of a different color. As the centrifugal force increases further, the first centrifugal switch, SW1, remains extended and then the second centrifugal switch of higher mass, SW2, also swings open. As a result, the second light is disconnected and the third light 22, preferably one of a different color, is activated.

Thus, by sequentially activating a plurality of different colored light means, the plurality of centrifugal switch means 24 provides an indication of the amount of centrifugal force created, and thus the amount of skill with which the hollow body 10 is being manipulated.

Figure 6:
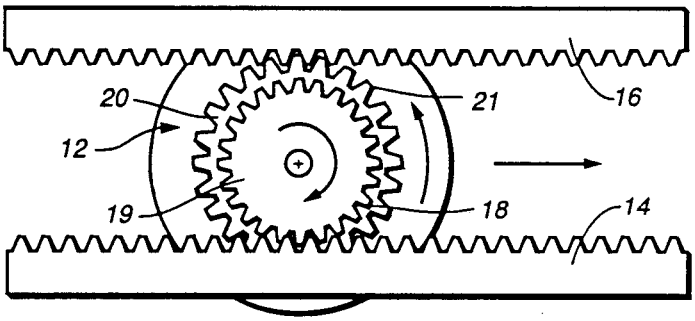
FIG. 6 is a detailed plan view illustrating the way in which the generator of FIG. 2 is supported by the rest of the device of FIG. 1.

Having described in detail the constituent components of the present invention, further attention is directed to the operation of the invention. FIG. 6 provides a detailed view of the cooperative relationship between the gear train means and the gear teeth means. The inner gear train 14 engages the inner gear teeth 18 which in turn causes the first gear disc 19 to rotate in a clockwise direction as the generator assembly 12 itself moves in a clockwise direction. This rotation results in rotation of the rotor assembly as previously described. At the same time, the outer gear train 16 engages the outer gear teeth 20 which in turn causes the second gear disc 21 and the body of the generator to rotate in a counterclockwise direction as the generator assembly 12 itself moves in a clockwise direction. This rotation results in rotation of the stator assembly as previously, described. Rotating in opposite directions, the stator and rotor generate enhanced current.

Figure 10:
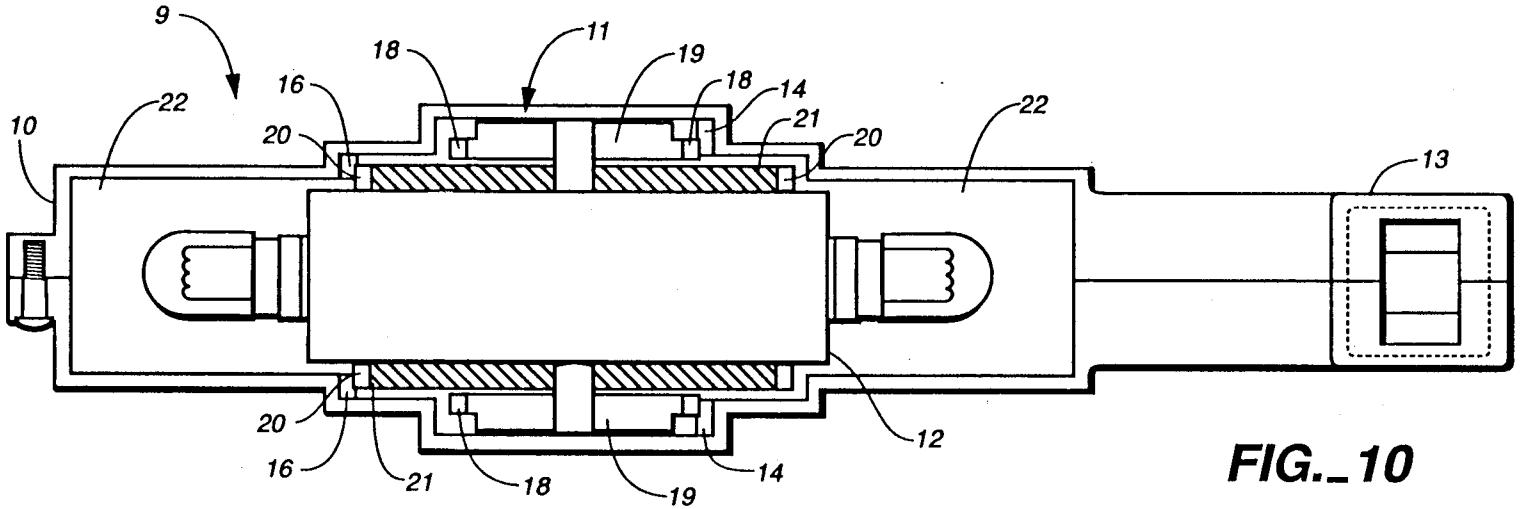
FIG. 10 is a side view of the generator assembly within the hollow body.

This interaction is also depicted in FIG. 10. The inner gear teeth 18 on the outer circumference of the first gear disc 19 engage the inner gear teeth 14 on the right side of the annular path 11. The outer gear teeth 20 on the outer circumference of the second gear disc 21 engage the outer gear teeth 16 on the left side of the annular path 11.

The action depicted in FIGS. 6 and 10 is a result of manual manipulation of the hollow body 10. For instance, if one were to hold the exercise device 9 as depicted in FIG. 1, and then begin to move the exercise device 9 in a cyclical motion, the generator assembly 12 would begin to move along its predetermined path 11. Such movement would produce interaction between gear teeth and gear trains, which would result in interaction between stator and rotor, which would produce electricity, as previously described. Depending upon the amount of sustained manipulation of the hollow body 10, electricity would then be sequentially directed to the various light means via the centrifugal switches, all having been previously described.

Figure 11:
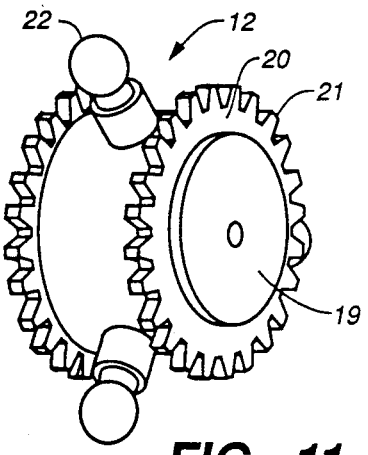
FIG. 11 is a perspective view of an alternate embodiment of the generator.
Figure 12:
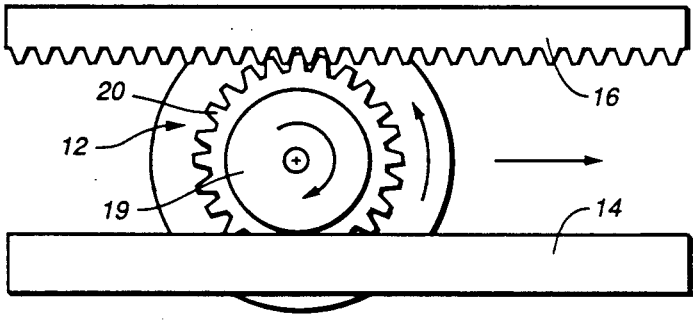
FIG. 12 is a detailed plan view illustrating the way in which the generator of FIG. 11 is supported in an alternate embodiment of the invention.
Figure 13:
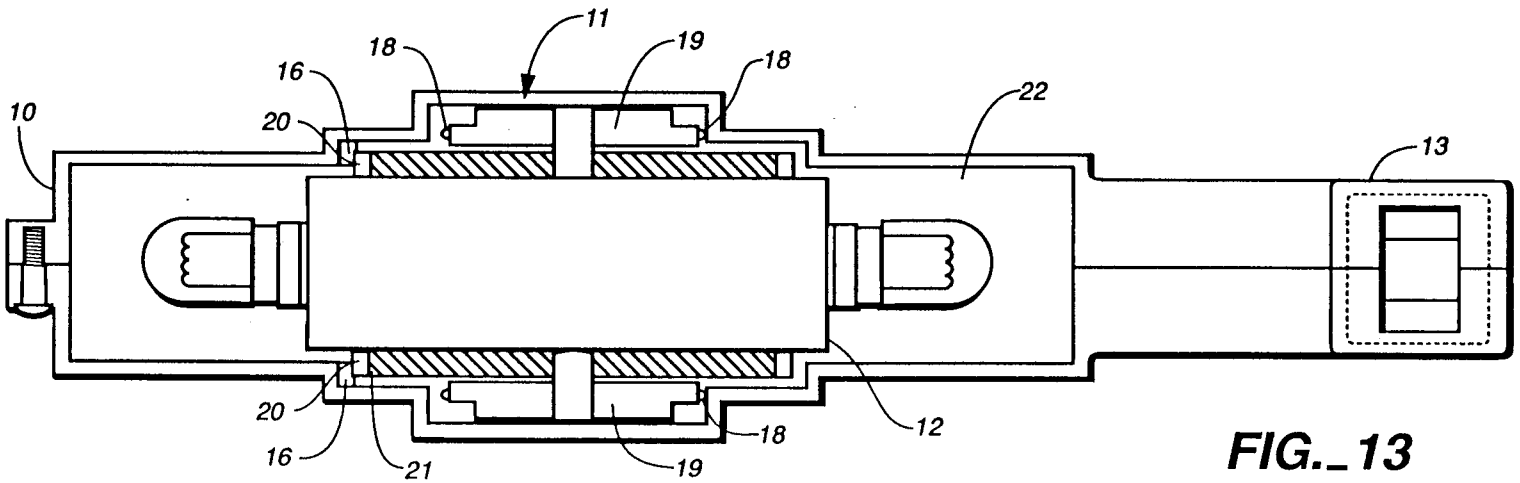
FIG. 13 is a side view of an alternate embodiment of the generator assembly within the hollow body.

While a preferred embodiment of the present invention has been revealed, it is clear that alternative embodiments are also feasible. For instance, the generator assembly 12 need not include gear teeth. In lieu of gear teeth one may utilize a flat surface lined with, for example, rubber. FIG. 11 depicts such an embodiment. Note that while the outer gear teeth 20 of the second gear disc 21 are identical to those depicted in FIG. 4, the first gear disc 19 has its outer circumference lined with rubber instead of gear teeth. FIG. 12 displays the operation of such an embodiment. The relative motions are identical to those found and described in accordance with FIG. 6, the sole difference being the replacement of inner gear teeth 18 with rubber and the replacement of the inner gear train 14 with a smooth surface, or a surface lined with rubber. This embodiment is also revealed in FIG. 13. The description associated with this figure is identical to that associated with FIG. 10 with the exception being the replacement of inner gear teeth 18 with rubber and the replacement of the inner gear train 14 with a smooth surface, or a surface lined with rubber. While inner gear teeth 18 and inner gear train 14 can be lined with rubber, other friction engaging, generally smooth surfaces, can be used rather than gear teeth. This is also true for the outer gear train 16 and the cooperating outer disc 21 (second disc).

Another feasible embodiment of the present invention is to replace the lamp means 22 (the three lamps) of the preferred embodiment with an audio activation means (three noise producing devices). Each individual audio activation means could be a small speaker tuned to a specified pitch. The centrifugal switch means 24 would then sequentially feed individual speaker means to produce a variety of sounds. Thus, in FIG. 11 the lamp means have been replaced with speaker means in accordance with this alternate embodiment.

Thus, it is clear that the activation means is not limited to light means. Audio means, a combination of light and audio means, or any similar combination is also available. In the same way, replacement of one or more sets of a gear trains and gear teeth with substituted means of engagement produces viable alternate embodiments of the present invention.

Figure 7:
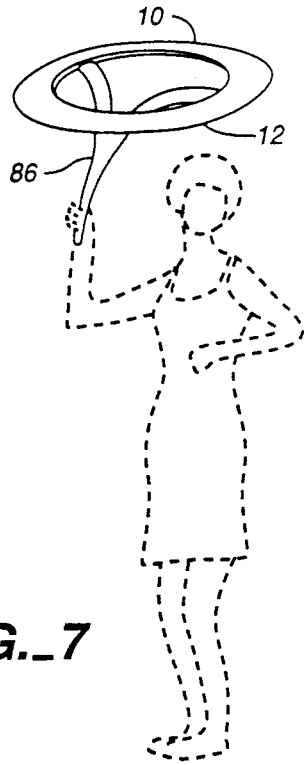
FIG. 7 depicts the embodiment of FIG. 1, with alternate optional handling means, being used as an exercise device of skill and amusement.

The hollow body may also be altered. For instance, in FIG. 1 the hollow body 10 may or may not include handles 13. Similarly, in FIG. 7 an optional extended handle 86 is attached to the circular hollow body 10 of FIG. 1. In this configuration, the extended handle 86 is molded to the hollow body 10 using injection molding techniques well known in the art. The extended handle 86 thereby facilitates manipulation of the exercise device of the present invention.

Figure 8:
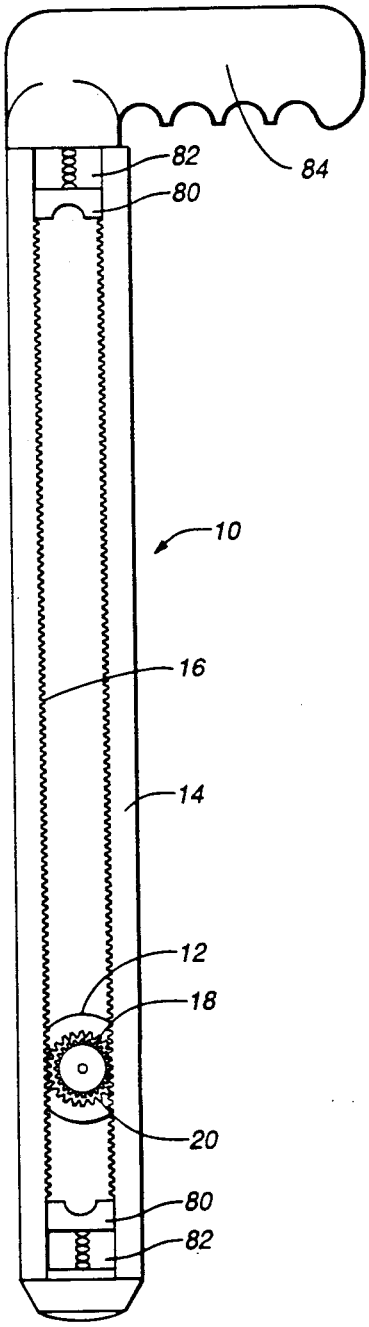
FIG. 8 is a plan view of an exercise device designed in accordance with a second embodiment of the present invention.

Other embodiments of the hollow body 10 are also feasible. FIG. 8 reveals hollow body 10 in a linear shape. This configuration, as the circular embodiment, includes a generator assembly 12, inner gear teeth 18, and outer gear teeth 20, along with inner gear train 14 and outer gear train 16. At the terminal ends of the linear hollow body are bumpers 80 and springs 82 providing return action. Preferably, the hollow body 10 includes a handle 84 to facilitate easy manipulation of the hollow body. It is noted that in this configuration there is not an orbital component to centrifugal force, however, there is still rotational centrifugal force.

Figure 9:
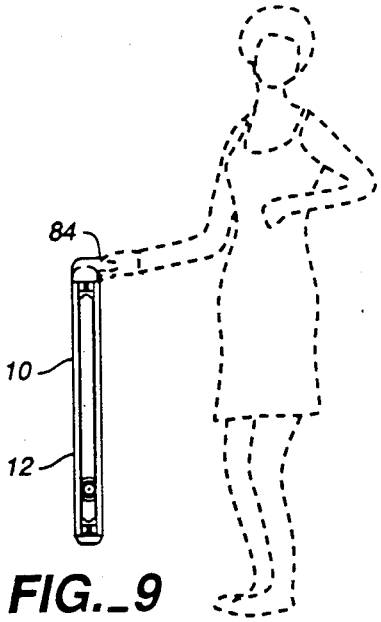
FIG. 9 depicts the embodiment of FIG. 8 being used as an exercise device of skill and amusement.

FIG. 9 depicts the handle 84 of the hollow body 10 in the hands of a human who is thereby able to manipulate the exercise device of skill and amusement in accordance with the present invention.

Thus it is apparent that there has been provided, in accordance with the invention, an exercise device of skill and amusement that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An exercise device of skill and amusement, comprising:

(a) generator means including stator means, rotor means and electric output means;

(b) means for supporting said generator means for movement along a predetermined path such that movement of said generator means along said path automatically causes at least one of said stator means and said rotor means to rotate relative to the other, whereby to generate electric power at said output means; and (c) electrically powered action means supported by said support means and electrically connected with the output means of said generator means for receiving power from said generator means whereby a centrifugal force is imparted to said generator means as the latter moves around said path, whereby an individual can manipulate said support means to cause said generator means to move along said path and thereby energize said action means.

2. Exercise device of skill and amusement of claim 1 wherein said generator means is supported by said support means such that said stator means rotates in one direction while said rotor means simultaneously rotates in the opposite direction.

3. Exercise device of skill and amusement of claim 1 wherein said support means and said generator means include cooperating gear means for causing said stator means and rotor means to rotate when said generator means moves along said predetermined path.

4. Exercise device of skill and amusement of claim 3 wherein said gear means includes a first gear arrangement on one side of the path and a second gear arrangement on the other side of the path and wherein said stator means and rotor means include gear teeth means cooperating with the respective gear arrangements.

5. Exercise device of skill and amusement of claim 1 wherein said action device is supported on and movable with said generator means.

6. Exercise device of skill and amusement of claim 1 wherein said predetermined path is a straight path.

7. Exercise device of skill and amusement of claim 6 wherein the terminal ends of said predetermined path include spring return means.

8. Exercise device of skill and amusement of claim 6 wherein said straight path includes handling means suitable for facilitating manual manipulation of said housing means.

9. Exercise device of skill and amusement of claim 1 wherein said predetermined path is a circular path.

10. Exercise device of skill and amusement of claim 9 wherein said circular path includes handling means suitable for facilitating manual manipulation of said housing means.

11. Exercise device of skill and amusement of claim 1 wherein said support means is formed from plastic.

12. Exercise device of skill and amusement of claim 1 wherein said action means includes light emitting means.

13. Exercise device of skill and amusement of claim 1 wherein said action means includes audio emitting means.

14. Exercise device of skill and amusement of claim 1 wherein said predetermined path is generally circular wherein said generator means includes a plurality of electrically powered action means connected to said output means, and wherein the generator means includes centrifugal switch means connected to said output means for sequentially electrically connecting said plurality of action means to said output means as said centrifugal force increases.

* * * * *